US006000408A

United States Patent [19]

Maturaporn

[11] Patent Number: 6,000,408

[45] Date of Patent: Dec. 14, 1999

[54] TUBULAR JERSEY AND RIB SEWINGLESS SCRUNCHY

[76] Inventor: Thawatchai Maturaporn, 228/68-69 Soi Siriwatana, Sathupradith Road, Bangklo, Bang Koleam, Bangkok 10120, Thailand

[21] Appl. No.: 08/966,301

[22] Filed: Nov. 7, 1997

[51] Int. Cl.[6] ..... A45D 8/36

[52] U.S. Cl. ..... 132/273; 2/174

[58] Field of Search ..... 132/273, 276; 2/322, 321, 174, DIG. 11

[56] References Cited

U.S. PATENT DOCUMENTS

| | | | |
|---|---|---|---|
| 536,965 | 4/1895 | Neuberger | 132/273 |
| 537,542 | 4/1895 | Moore | 132/275 |
| 2,795,232 | 6/1957 | Klein et al. | 132/275 |
| 5,044,385 | 9/1991 | Rhodes | 132/273 |
| 5,156,171 | 10/1992 | Goodman | 132/273 |
| 5,301,696 | 4/1994 | Revson | 132/273 |
| 5,379,782 | 1/1995 | Tabb | 132/273 |
| 5,413,126 | 5/1995 | Revson | 132/273 |

*Primary Examiner*—Paul J. Hirsch
*Attorney, Agent, or Firm*—David & Raymond; Raymond Y. Chan

[57] ABSTRACT

A tubular jersey and rib sewingless scrunchy includes a holding element and a sewingless tubular fabric coating wrapping around the holding elements, wherein the holding element is a loop shape fabric elastic band and the sewingless tubular fabric coating is made of a tubular jersey and rib material wrapping around the loop shape fabric elastic band, two ends of the sewingless tubular fabric coating being connected together by ultrasonic welding to form an endless body. Accordingly, since the tubular jersey and rib sewingless scrunchy of the present invention has no sewing line provided along the length of the fabric coating of the scrunchy, so that it is free of the risk of splitting or rending at such sewing line. Moreover, the improved structure of the scrunchy is adapted for mass production with minimum processing steps, wherein no sewing process is required to manufacture the scrunchy, that can largely save the production time and the production cost.

1 Claim, 4 Drawing Sheets

TUBULAR JERSEY AND RIB SEWINGLESS SCRUNCHY

BACKGROUND OF THE PRESENT INVENTION

The present invention relates to a hair styling accessory, and more particularly to a tubular jersey and rib sewingless scrunchy which has no sewing line formed along its length so as to prevent splitting and rending at such sewing line when it is under tension, and that the more durable scrunchy of the present invention can be manufactured by simplified process that may also reduce the cost of the scrunchy.

Ladies spend much money on purchasing various hair styling accessories. Especially young girls today, they treat the hair styling accessory such as scrunchy not merely for functional purpose, but also is a fashion statement that can be used to match with different dresses. Most young girls have at least five designs of scrunchy with different color, size, or material to wear during different occasion. When ladies find any new design of scrunchy, they tend to have a desire to possess them.

The conventional scrunchy 10 has a great shortcoming of having a complicated manufacturing process that requires a lot of man made labor. The conventional scrunchy 10, as shown in FIG. 1A, comprises a roll up fabric coating 11 and an elastic element 12 which two ends are sewed together to form a loop shape. The elastic element 12 is covered by the roll up fabric coating 11 to provide the elastic ability of the scrunchy 10. The roll up fabric coating 11 is normally and initially cut into a rectangular piece, as shown in FIG. 1B. A first sewing edge 13 and a second sewing edge 14 of the fabric coating 11 are sewed together to form a tubular body 11*a,* as shown in FIG. 1C.

While manufacturing, the elastic element 12 has to penetrate through the tubular body 11*a,* and then the two ends of the elastic element 12 are sewed together to form the loop shape. Afterwards, a first sewing end 15 of the tubular body 11*a* is looped around to be sewed with a second sewing end 16 along with the elastic element 12 positioned therein to form the conventional scrunchy 10 (as shown in FIG. 1A).

Accordingly, the manufacturing of the conventional scrunchy needs to have plenty of human labor of sewing work, including to sew the first sewing edge 13 and the second sewing edge 14 together to form the tubular body 11*a,* to sew up the two ends of the elastic element 12 after the elastic element 12 is placed within the tubular body 11*a,* and to further sew the first sewing end 15 and the second sewing end 16 together to form the conventional scrunchy 10. The time and the labor cost for producing the conventional scrunchy certainly is not the most efficient way for mass production, therefore the price of the final product of the conventional scrunchy 10 is nearly impossible to further reduce.

Moreover, as shown in FIG. 1A, the sewing lines 17 and 18 of the final product of the conventional scrunchy 10 greatly reduce the aesthetic aspect of the conventional scrunchy 10. In fact, the protruding sewing lines 17, 18 not only affect the aesthetic aspect of the conventional scrunchy 10, but also may cause uncomfortable feeling to the user when it is propped against the user's head and may reduce the frictional contact area between the hair of the user and the scrunchy 10. Moreover, in order to tightly bind the hair into a bundle, the user normally would apply great tension to the scrunchy 10 by overlappedly and repeatedly looping the scrunchy 10 to the user's hair. As a result, the conventional scrunchy 10 will easily be disassembled and broken while either the sewing line 17 or 18 is split open or rent apart under tension.

SUMMARY OF THE PRESENT INVENTION

The main objective of the present invention is to provide a tubular jersey and rib sewingless scrunchy which has no sewing line provided along the length of the fabric coating of the scrunchy, so that it is free of the risk of splitting or rending at such sewing line.

Another objective of the present invention is to provide a tubular jersey and rib sewingless crunchy which has an improved structure adapted for mass production with minimum processing steps, wherein no sewing process is required to manufacture the scrunchy, that can largely save the production time and the production cost.

Accordingly, a tubular jersey and rib sewingless scrunchy comprises a holding element, and a sewingless tubular fabric coating wrapping around the holding elements, wherein the holding element is a loop shape fabric elastic band and the sewingless tubular fabric coating is made of a tubular jersey and rib material wrapping around the loop shape fabric elastic band, two ends of the sewingless tubular fabric coating being connected together by ultrasonic welding to form an endless body.

The tubular jersey and rib sewingless scrunchy of the present invention is manufactured by as simple as a three-step process, in which:

1. Cut a large roll of sewingless jersey and rib tube into a plurality of elongated sewingless fabric tubes, each fabric tube forming a tubular fabric coating having a predetermined length longer than a length of a fabric elastic band.

2. Penetrate the fabric elastic band through the tubular fabric coating and connect two ends of the fabric elastic band to form a loop shape fabric elastic band, wherein the tubular fabric coating wrapped around the loop shape fabric elastic band generates a plurality of wrinkles along the sewingless tubular fabric coating.

3. Connect two ends of the sewingless tubular fabric coating by ultrasonic welding by means of an ultrasonic machine.

DETAILED DESCRIPTION OF THE PREFERRED EMBODIMENT

Figure 1C:
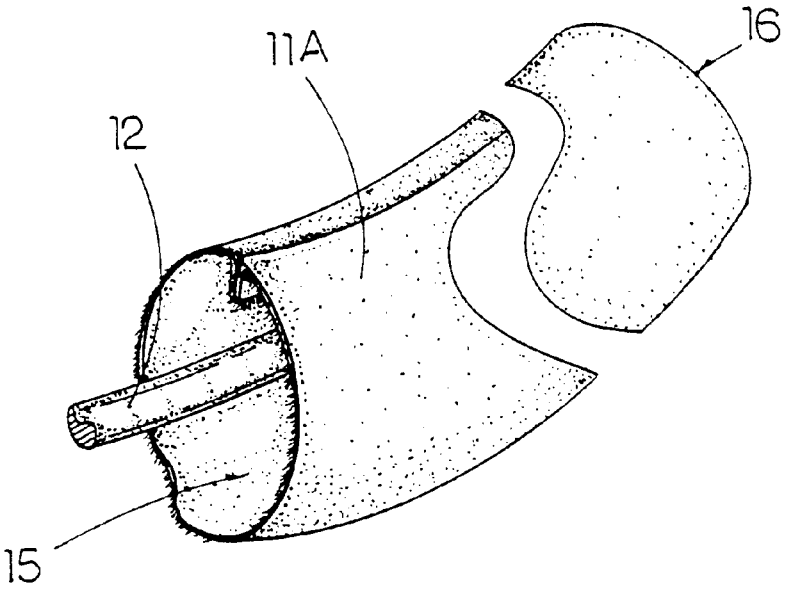
FIG. 1C is a perspective view of a semi-finish product of the above conventional scrunchy, illustrating the tubular body of the fabric coating.
Figure 1A:
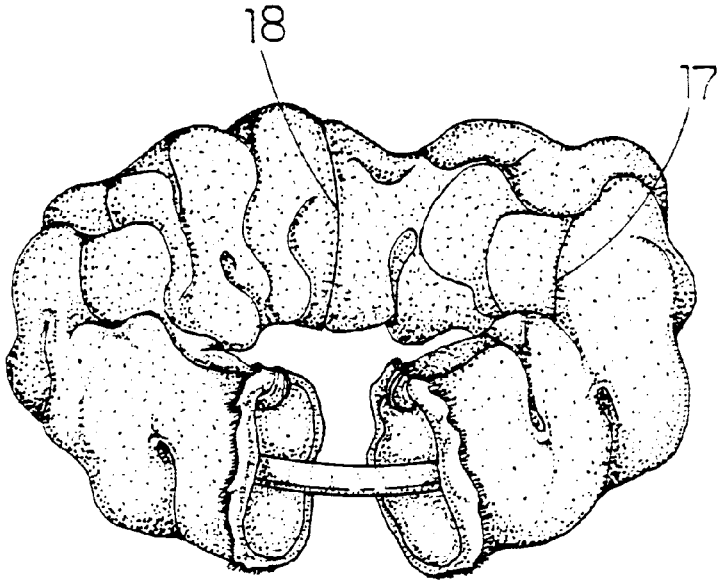
FIG. 1A is a partial sectional perspective view of a conventional scrunchy with the sewing lines present.
Figure 1B:
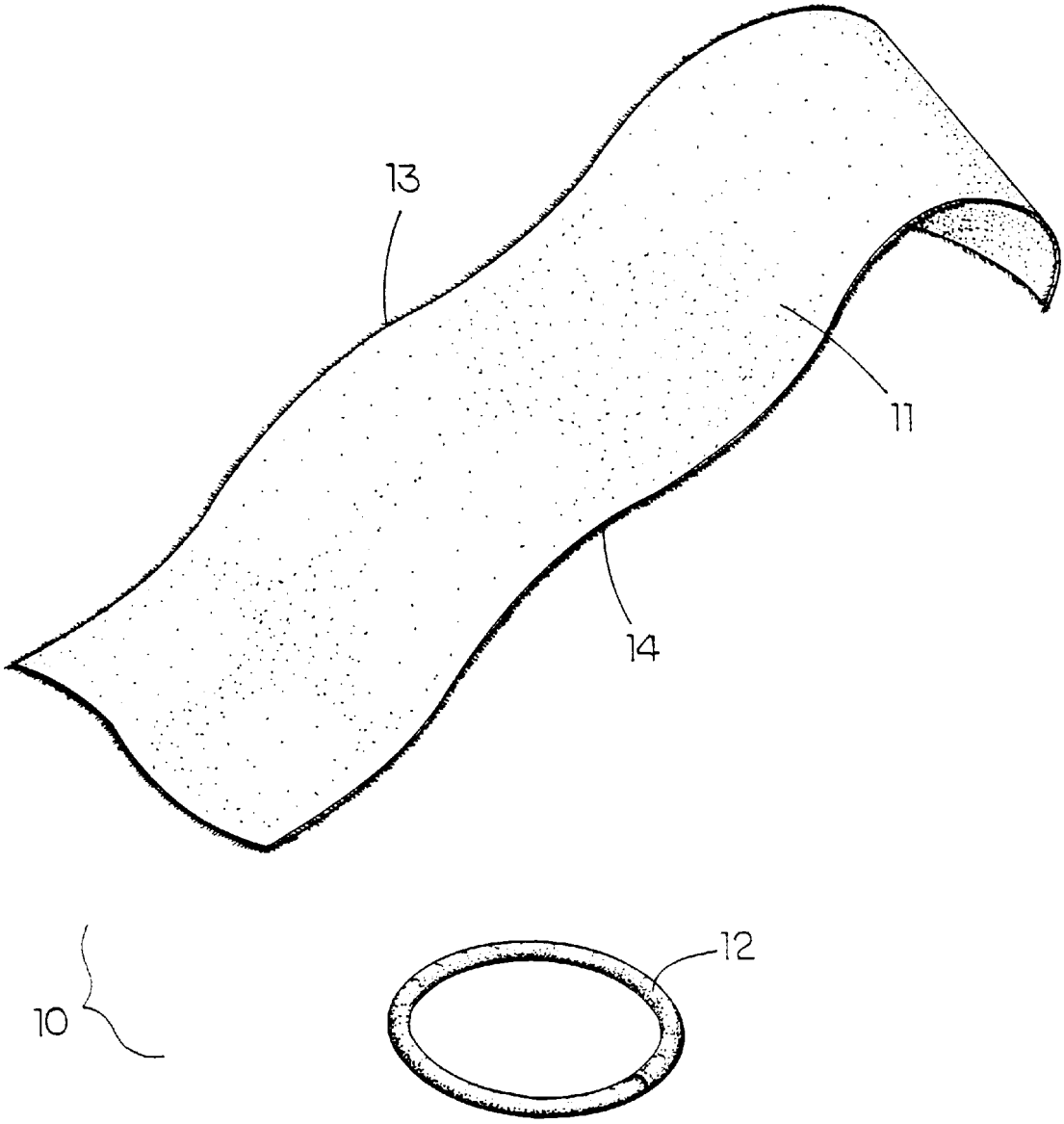
FIG. 1B is a perspective view of a piece of rectangular fabric coating and an elastic element of the conventional scrunchy.

Referring to FIGS. 2 to 5 of the drawings, a tubular jersey and rib sewingless scrunchy according to a preferred embodiment of the present invention is illustrated. The tubular jersey and rib sewingless scrunchy comprises a holding element 21 and a sewingless tubular fabric coating 22 wrapping around the holding element 21, wherein the holding element is a loop shape fabric elastic band 21 and the sewingless tubular fabric coating 22 is made of a kind of tubular jersey and rib material for wrapping around the loop shape fabric elastic band 21. The sewingless tubular fabric coating 22 has a length longer than a length of the fabric elastic band 21 and a diameter much larger than that of the fabric elastic band 21, so that a plurality of wrinkles 23 are formed evenly along the length of the sewingless tubular fabric coating 22. Two ends of the sewingless tubular fabric coating 22 are connected together by ultrasonic welding by means of an ultrasonic machine (not shown in figures) to form an endless body, wherein along the entire tubular fabric coating 22, no sewing line formed thereon.

The sewingless tubular fabric coating 22 is cut from a large roll of knitting elongated sewingless jersey and rib fabric tube 22A, as shown in FIG. 5*a*. A fabric elastic band 21 which has a predetermined length shorter than the sewingless tubular fabric coating 22 is penetrated into the sewingless tubular fabric coating 22, as shown in FIG. 5*b*.

Two ends of the fabric elastic band 21 are connected together by ultrasonic welding or sewing to form the loop shape, as shown in FIG. 5*c*, wherein since the length of the sewingless tubular fabric coating 22 is longer than the fabric elastic band 21, a plurality of wrinkles 23 will be formed along the length of the sewingless tubular fabric coating 22.

As shown in FIG. 5*d*, a first end 221 of the sewingless tubular fabric coating 22 is then folded inwardly and a second end 222 of the sewingless tubular fabric coating 22 is inserted into the folded first end 221 to enable the first and second ends 221, 222 overlapping with each other so that a smooth finishing edge is presented. The overlapped first and second ends 221, 222 of the sewingless tubular fabric coating 22 are connected with each other by ultrasonic welding by means of an ultrasonic machine, in which at least two ultrasonic welding spots 223 are formed to integrally weld the first and second ends 221, 222 together, so that an endless scrunchy body is formed.

As mentioned above, in order to form wrinkles 23 along the length of the sewingless tubular fabric coating 22, the sewingless tubular fabric coating 22 has larger size than the fabric elastic band 21 wrapped therein. In this stage, as shown in FIG. 5*d*, like the conventional scrunchy, the fabric elastic band 21 inside the sewingless tubular fabric coating 22 will gather to one side of the sewingless tubular fabric coating 22, so that the wrinkles 23 formed will not be evenly distributed that may increase the difficulty of binding to the user's hair.

Figure 2:
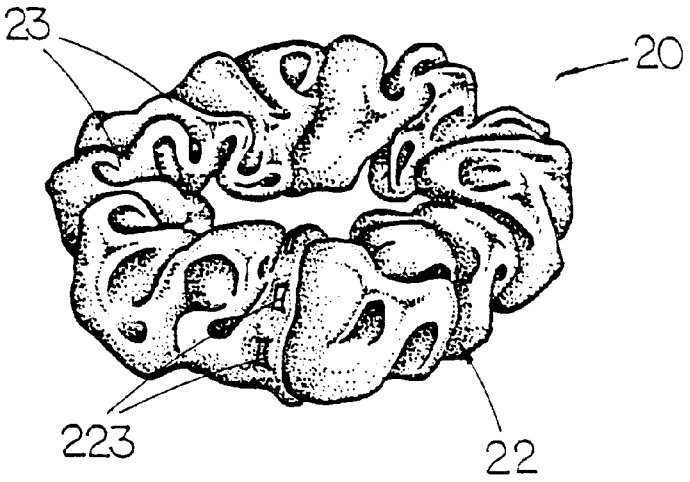
FIG. 2 is a perspective view of a tubular jersey and rib sewingless scrunchy according to a preferred embodiment of the present invention.
Figure 3:
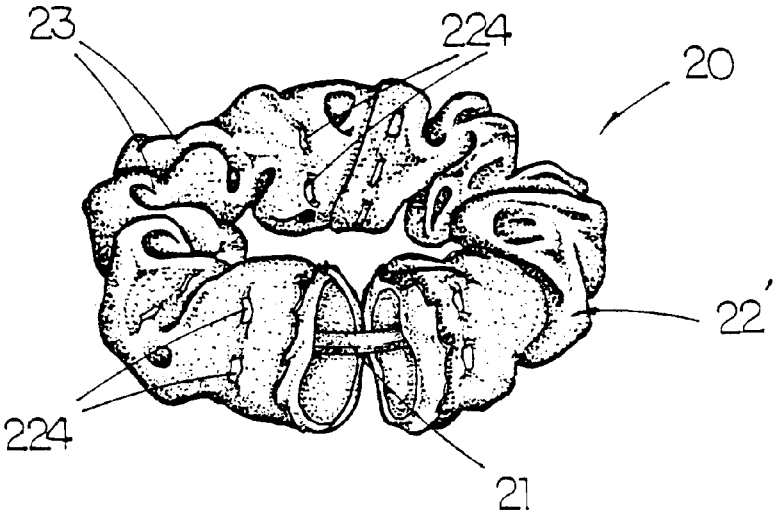
FIG. 3 is a partial sectional perspective view of the tubular jersey and rib sewingless scrunchy according to the above preferred embodiment of the present invention.
Figure 4:
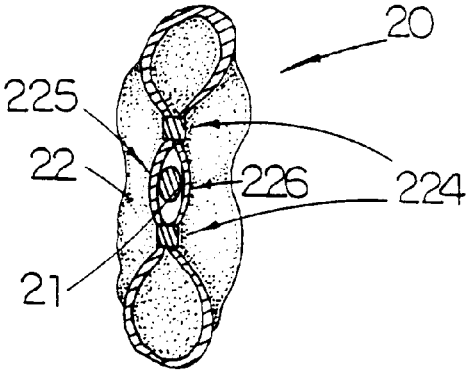
FIG. 4 is a sectional view of the tubular jersey and rib sewingless scrunchy according to the above preferred embodiment of the present invention, illustrating how the ultrasonic welding spots welding the front layer and the back layer of the sewingless tubular fabric coating together to guide the fabric elastic band in a central position.
Figure 5:
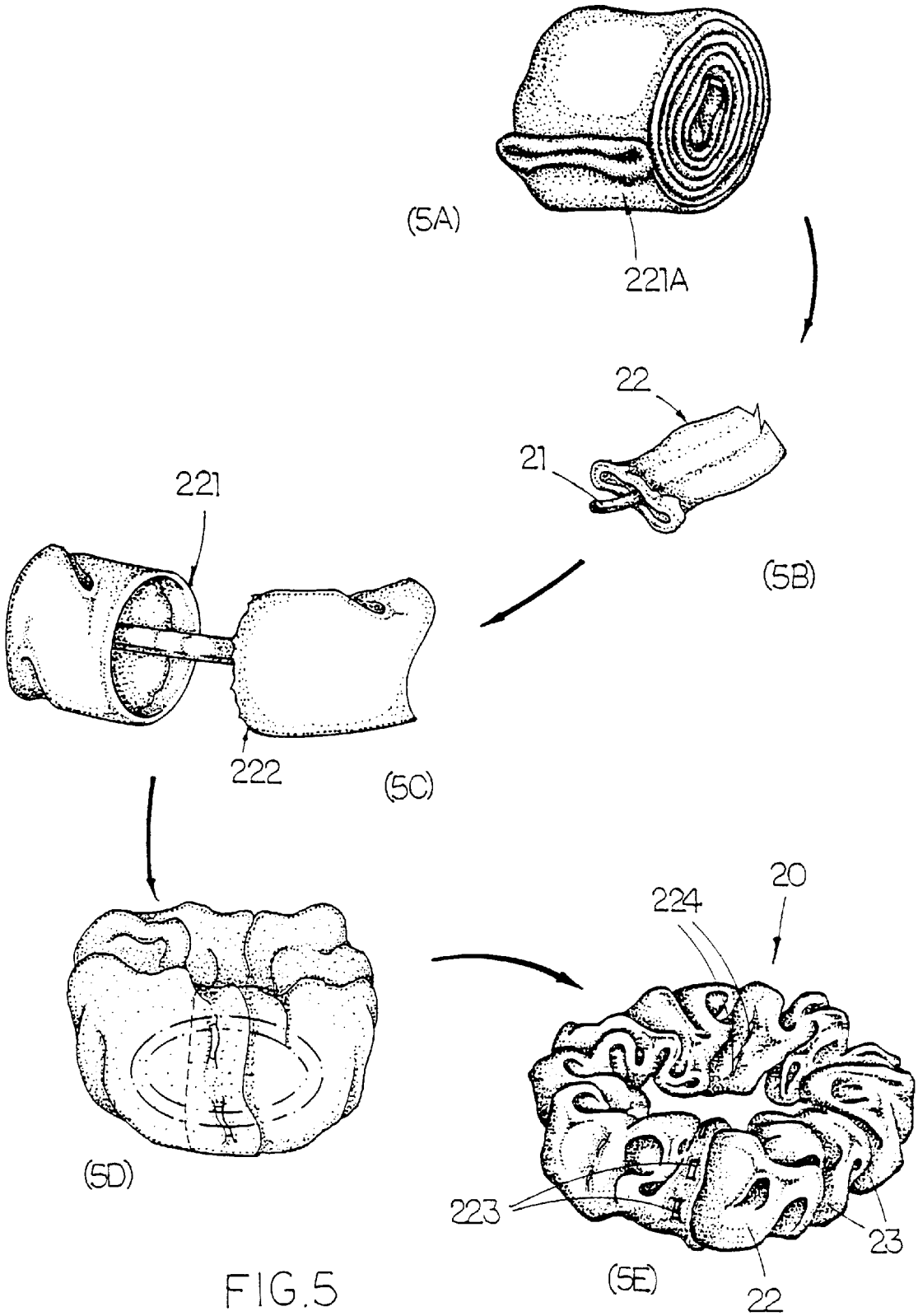
FIGS. 5(*a–e*) illustrates a manufacturing process of the tubular jersey and rib sewingless scrunchy according to the above preferred embodiment of the present invention.

In order to ensure the wrinkles 23 evenly distributing along the sewingless tubular fabric coating 22 and the fabric elastic band 21, as shown in FIGS. 2 and 5*e*, a plurality pairs of ultrasonic welding spots 224 are spacedly and intervally welded to a central portion of the sewingless tubular fabric coating 22 for welding a front layer 225 and a back layer 226 of the sewingless tubular fabric coating 22 together, so that the wrinkles 23 would be evenly distributed between the pairs of ultrasonic welding spots 224. In addition, in order to ensure the wrinkles 23 remaining to position in a central portion of the sewingless tubular fabric coating 22, each pair of ultrasonic welding spots 224 is aligned at the central portion of the sewingless tubular fabric coating 22 and has an upper spots and a lower spots, wherein a distance between the upper spot and the lower spot must be larger than a width of the fabric elastic band 21, so that the fabric elastic band 21 is positioned and guided between the upper spot and the lower spot of each pair of ultrasonic welding spots 224. Thus, the tubular jersey and rib sewingless scrunchy of the present invention is formed.

The wrinkles 23 which are centrally and evenly provided on the surface of the sewingless tubular fabric coating 22 not only can enhance the grabbing ability between the tubular jersey and rib sewingless scrunchy 20 and the hair of the user, but also can improve the outlook of the tubular jersey and rib sewingless scrunchy 20.

It is apparent that throughout the manufacturing process of the tubular jersey and rib sewingless scrunchy 20 of the present invention as disclosed above, no sewing work is involved that may save a great deal of time and human labor. The ultrasonic welding process can be done by ultrasonic welding machine. In fact, a specific fully or semi-automatic production line can be design to manufacture the tubular jersey and rib sewingless scrunchy 20 automatically. In other words, the tubular jersey and rib sewingless scrunchy 20 of the present invention has an improved structure most suitable for mass production. Therefore the material cost, manufacturing time and the labor cost can be greatly reduced, and thus the final product cost can also be benefited.

What is claimed is:

1. A tubular jersey and rib sewingless scrunchy, comprising an elastic band having two ends connected together to form a loop shape; and a sewingless tubular fabric coating, which is made of tubular jersey and rib fabric, having a length longer than a length of said elastic band and a diameter larger than that of said elastic band, said sewingless tubular fabric coating wrapping around said elastic band, so that a plurality of wrinkles are formed along said length of said sewingless tubular fabric coating, two ends of said sewingless tubular fabric coating being connected together by ultrasonic welding to form an endless body, wherein no sewing line is formed along said length of said sewingless tubular fabric coating, wherein a first end of said sewingless tubular fabric coating is folded inwardly and a second end of said sewingless tubular fabric coating is inserted into said folded first end to enable said first and second ends overlapping with each other, said overlapped first and second ends of said sewingless tubular fabric coating being connected with each other by ultrasonic welding, in which at least two ultrasonic welding spots are formed to integrally weld said first and second ends together, so that an endless scrunchy body is formed, and moreover a plurality of pairs of ultrasonic welding spots are spacedly and intervally provided to a central portion of said sewingless tubular fabric coating by welding a front layer and a back layer of said sewingless tubular fabric coating together to enable said wrinkles being evenly distributed between said pairs of ultrasonic welding spots, and that each pair of said ultrasonic welding spots is aligned at said central portion of said sewingless tubular fabric coating and has an upper spot and a lower spot, wherein the distance between said upper spot and said lower spot is larger than the width of said elastic band, so that said elastic band is positioned and guided between said upper spot and said lower spot of each pair of said ultrasonic welding spots.

* * * * *